United States Patent [19]

Leoncavallo et al.

[11] Patent Number: 4,898,278

[45] Date of Patent: Feb. 6, 1990

[54] STORAGE CONTAINER

[75] Inventors: Richard A. Leoncavallo, Pittsford; Linda J. Kover, Rochester; Gregory R. Phillips, Penfield, all of N.Y.

[73] Assignee: Nalge Company, Rochester, N.Y.

[21] Appl. No.: 212,269

[22] Filed: Sep. 19, 1988

Related U.S. Application Data

[63] Continuation of Ser. No. 938,187, Dec. 5, 1986, abandoned.

[51] Int. Cl.[4] ..... B65D 85/20

[52] U.S. Cl. ..... 206/443; 206/459; 220/353; 220/356

[58] Field of Search ..... 206/588, 459, 443, 561, 206/534, 446; 220/353, 21, 352, 355, 356; 40/306, 307, 312

[56] References Cited

U.S. PATENT DOCUMENTS

| | | | |
|---|---|---|---|
| D. 246,854 | 1/1978 | Baker | D22/18 |
| 2,606,708 | 8/1952 | Irvan | 22/356 |
| 3,056,525 | 10/1962 | Deinert | 220/21 |
| 3,063,551 | 11/1962 | Russell | 206/456 |
| 3,593,873 | 7/1971 | Vonk | 220/21 |
| 3,627,122 | 12/1971 | Garbe, Jr. | 206/459 |
| 3,643,812 | 2/1972 | Mander et al. | 206/443 |
| 3,649,464 | 3/1972 | Freeman | 220/21 X |
| 3,743,088 | 7/1973 | Henkin | 220/459 X |
| 4,034,884 | 7/1977 | White | 220/355 |
| 4,039,080 | 8/1971 | Cappuccilli | 206/534 |
| 4,195,059 | 3/1980 | Whitcher et al. | 206/459 |
| 4,227,613 | 10/1980 | Seitz | 206/459 |
| 4,254,871 | 3/1981 | Poore | 206/534 |
| 4,473,156 | 9/1984 | Martin | 206/534 |
| 4,510,119 | 4/1988 | Hevey | 206/443 |
| 4,646,933 | 3/1987 | Jurczenia et al. | 220/352 |
| 4,671,405 | 1/1987 | Hagan | 220/21 |

FOREIGN PATENT DOCUMENTS

| | | | |
|---|---|---|---|
| 2017064 | 9/1979 | United Kingdom | 220/352 |

*Primary Examiner*—Joseph Man-fu Moy
*Attorney, Agent, or Firm*—Marjama & Pincelli

[57] ABSTRACT

A plastic container for hoding an array of vials or other like articles. The container has a base potion and a top cover for placement thereon. The base portion is provided a divider defining a plurality of openings for receiving and maintaining in position a plurality of vials or other like artivles. The divider is provided with indica for identifying the position of the vials.

10 Claims, 2 Drawing Sheets

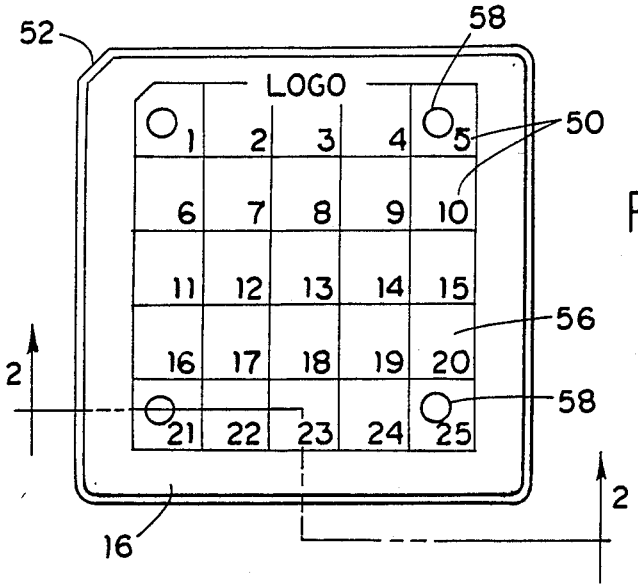
FIG. 1
FIG. 2
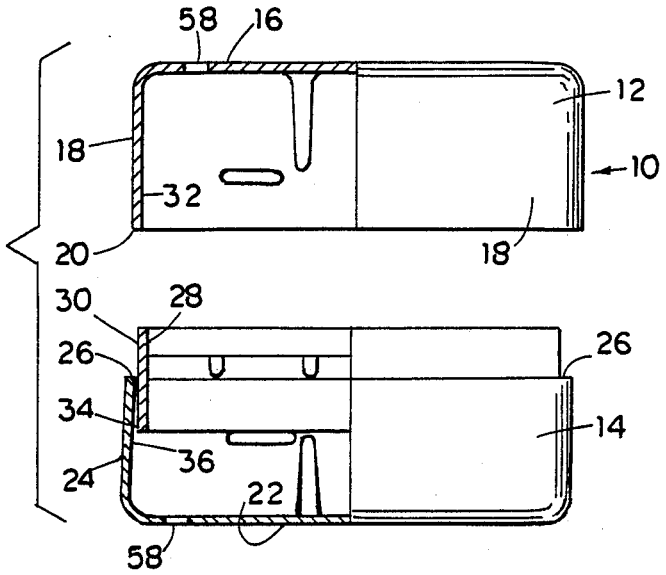

STORAGE CONTAINER

This is a continuation of application Ser. No. 938,187 filed on Dec. 5, 1986 now abandonded.

This invention relates to storage containers for holding a plurality of vials or other like articles having an inventory system which allows quick and easy removal of the vials stored therein.

BACKGROUND OF THE INVENTION

In the medical and biological research fields it is often necessary to store and preserve numerous culture samples or biological specimens for later evaluation, inspection and/or use. Generally these specimens and/or samples are placed in individual glass or plastic vials or other like containers. A plurality of these vials are then placed into a single container which is placed in a mechanical freezer or liquid nitrogen. In the past these containers have been made of cardboard or stainless steel. As part of the normal investigation work of a researcher, it is often necessary to retrieve one or several particular vials outs of the group of vials in any particular storage container. An inventory system of the prior art generally takes the form of a written list identifying the contents of each vial in a particular container and some type of identifying position associated therewith. Generally the vials placed in the containers are arranged in some sort of an array, for example, a 9×9 array of openings for receiving an equal number of vials. Some containers have provisions for providing a label on the top cover for later providing identification of the contents. However, once the cover is removed there is no other indica within the container for identifying the positioning of each individual vial. Further, since these containers are typically square, it is possible to place the cover on so that the label does not correspond to the position of the contents therein. Therefore, in removing a single vial from an array the user must be very careful to retrieve the particular vial or vials desired. Likewise when inserting vials into the container care must be taken so that the vial being inserted is in the appropriate position so desired.

With respect to specimens that are cold stored, especially with respect to specimens stored at cryogenic temperatures (approximately −70° Centigrade or lower), it is important that the vials that are not removed from the container be returned to the cryogenic environment as soon as possible. Typically, a cryogenic storage container may have up to 81 different vials. Therefore, it is possible that a particular vial will be removed and placed back into the cryogenic environment many times prior to its actual removal and use. In order to assure the viability of the specimen being stored, the time period in which the specimens are out of the cryogenic environment should be minimized. Typically these specimens are sensitive to temperature change. If a particular sample is taken out numerous times and allowed to stay out for a particularly long time, the viability of the specimens will deteriorate substantially, possibly to the point where recovery is no longer possible. Accordingly, it is important to have the vials that are not to be used be removed from the cryogenic environment, preferably for no more than approximately 30 seconds. Additionally, the storing of containers in a cold environment greatly inhibits, if not prevents, the writing and/or applying of a label thereon.

Applicants have invented a container having an improved inventory system which minimizes the problem of the prior art and is particularly adapted for use as a cryogenic storage container.

SUMMARY OF THE INVENTION

A plastic container for holding an array of vials or other like articles. The container has a base portion and a top cover for placement thereon. The base portion is provided a divider defining a plurality of openings for receiving and maintaining in position a plurality of vials or other like articles. The divider is provided with indica for identifying the position of the vials.

DESCRIPTION OF THE DRAWINGS

FIG. 1 is a top plan view of the container of the present invention;

FIG. 2 is a front elevational view of the invention illustrated in FIG. 1 partially broken away along line 2—2 with the cover in the open position;

DETAILED DESCRIPTION OF THE INVENTION

Figure 3:
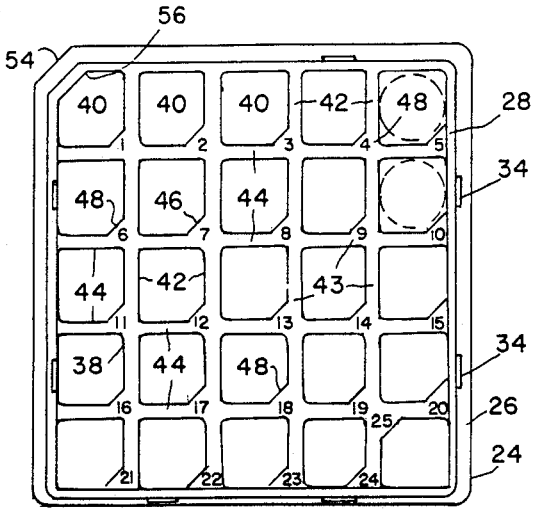
FIG. 3 is a top view of a base portion of a container of FIG. 2 taken along line 3—3.

Referring to FIGS. 1 and 2 there is illustrated a container 10 made in accordance with the present invention. A container 10 is made of a plastic material which is capable of withstanding low cryogenic temperatures and which is also capable of being exposed to temperatures experienced during dishwashing, autoclaving and/or sterilization. In the particular embodiment illustrated the container 10 is made of polycarbonate. The container 10 comprises of top cover 12 which sits on base portion 14. The cover 12 comprises a top wall 16 and a peripheral outer wall 18 which extends downwardly from top wall 16 and terminates at its lower end in rim portion 20.

The base portion 14 comprises a bottom wall 22 and an upstanding peripheral wall 24 extending therefrom which terminates in a ridge portion 26. When the top cover 12 is placed on base portion 14 in the closed position the rim 20 of top cover 12 mates with ridge portion 26 of base portion 14. Base portion 14 is further provided with retaining wall 28 which extends about the periphery of wall 24 and extends above ridge portion 26. The outer surface 30 of retaining wall 28 mates with the inside surface 32 of wall 18 when top cover 12 is placed on base portion 14 in the closed position. The retaining wall 28 is constructed so as to snap fit into the wall 24 of base portion 14. The outer surface 30 of retaining wall 28 at its lower ends is provided with a plurality of projection 34 (see FIG. 2) which snap into a mating recess 36 formed in wall 24. Retaining wall 28 positively positions the top cover 14 on base portion 14 and prevents axial movement therebetween. In the preferred form of the particular invention illustrated the retaining wall 20 is a separate piece, however, the retaining wall 28 may be integrally formed with or somehow otherwise secured to the outer peripheral wall 24 of base portion 14.

Integrally formed with retaining wall 28 is divider 38 which is spaced from bottom wall 22 of base portion 14. The divider 38 has a plurality of openings 40 for holding and maintaining in position a plurality of vials or other like articles. In the particular embodiment illustrated openings 40 are arranged in a 5×5 array where a total 25 separate individual openings 40 are provided. However any desired array may be selected with any desired number of openings. In the particular embodiment illustrated openings 40 are formed by a plurality of horizontal branches 42 and vertical branches 44 which connect oppositely disposed sides of retaining wall 28.

Associated with each individual opening 40 is a different indica 43 for identifying each position. The indica is permanently fixed to divider 38 so as to prevent accidental removal thereof and disposed directly adjacent each opening. Preferably indica 43 is placed in the same position for each opening 40. For example, in the embodiment illustrated indica 43 is disposed at the lower right hand corner of each opening. However, it is sometimes necessary to place the indica 43 in a different locality as illustrated in the lower right hand corner for position 25. In this particular instance due to molding techniques it is preferable to have the numeral 25 in the upper left hand corner. In the particular embodiment illustrated the indica associated with each opening are numerals. Since the particular embodiment illustrated is a 5×5 array of openings 40 the indica takes the form of numerals from 1 through 25. The numerals 1 through 25 are preferably integrally formed in divider 28 which project above the surface of branches 42, 44 as illustrated. However, other permanent marking may be provided, for example, it may be desirable to print indica 43 with an appropriate permanent ink.

In the particular embodiment illustrated the numerals are placed at the junction of the branches 42 and 44 where a marking surface 48 is provided by receiving the numerals. The openings 40 identified by numerals 5 and 10 illustrate in dash lines the relative position of a vial placed therein. As can be seen, marking surface 48 does not interfere with the placement of a vial or other like article. It is, of course, understood that the size of the marking surface 48 and branches 42, 44 may be any size desired so as to accommodate numerous size opening or indica. One of the primary interests is that these numerals should not interfere with the insertion or removal of vials placed in openings 40.

Referring to FIG. 1 it can be seen that the outer surface of top wall 16 is provided with identifiying indica 50 which is identical in identification to the indica 43 provided on the divider 38. The indica 50, in the particular embodiment illustrated are numerals 1 through 25, which are positioned to correspond with the position of the indica 43 on a divider 38 underneath. As also can be seen there is provided additional indica 56 on the cover in the form of a grid system thereby providing by individual areas wherein additional writing may be placed by permanent marking by a writing instrument if so desired. As also illustrated a space may be provided on top cover 12 identifying marking in the top portion of the cover such as a company logo.

Top cover 12 and bottom cover 14 are further provided with openings 58 which assist in the egress and ingress of a fluid or other gas medium into the container. For example when the containers are placed in a liquid nitrogen environment the openings 58 assist in allowing liquid nitrogen to flow within the container and upon removal assist in allowing drainage. In the particular embodiment illustrated the openings 58 in top cover 12 are disposed directly above the openings 58 in base portion 14.

The providing of numerals on the outside surface of the top cover 12 assist in orienting the box appropriately and to identifying the position of the vials inside. Once the top cover 12 is removed the divider having indica 43 thereon further assists in locating and identifying the appropriate positioning of the desired vial or vials.

In the particular embodiment illustrated the overall outer configuration of the container 10 is substantially square having an outer dimension of about 7.7 cm×7.7 cm. However, the container may be other shapes, for example, rectangular or hexagonal, or be sized to contain more vials as illustrated in FIG. 4.

In order to assure that the indica on top cover 12 directly corresponds to the indica on divider 38, the container 10 is provided with means for permitting closure of the top cover on base portion in only one way. In the particular embodiment illustrated means for assuring proper orientation of the top cover with respect to the divider is provided by beveling one corner of the base portion 14 and top cover 12. The corner 52 of top cover 12 (see FIG. 1), is beveled so as to mate with the corner 54 of base portion 14 (see FIG. 3). Likewise the retaining wall 28 is beveled at corner 26 so as to conform to the configuration of the top and bottom cover. The beveling of one corner provides a simple yet positive manner in which to assure the proper orientation and alignment of the top cover 12 with respect to the base portion 14 so that the indica on top cover 12 will correspond directly to the indica on divider 38 directly below. The beveled corner further assists the user in orienting the container so that the container properly face the user thus allowing the indica on divider 38 to be easily read. While the preferred embodiment of the present invention illustrates an indica on top cover 12 it may be possible to omit this indica in favor of an orientation indexing means which is associated with the indica on divider 38. For example, the beveled corners 52, 54 are adjacent the position identified by numeral number 1. Therefore, the user will simply orient the container so that the beveled corners 52, 54 are in the appropriate position so that the indica on divider 38 can be quickly and easily read when the cover is removed. It is understood that the present invention is not limited to the particular means for controlling the alignment of the cover with the base portion and the orientation of the container. The assuring of the orientation of the indica on top cover 12 with respect to the indica on divider 38 and base portion 14 or orientation of the indica on the divider when the cover is taken off may be accomplished in any other desired manner.

Figure 4:
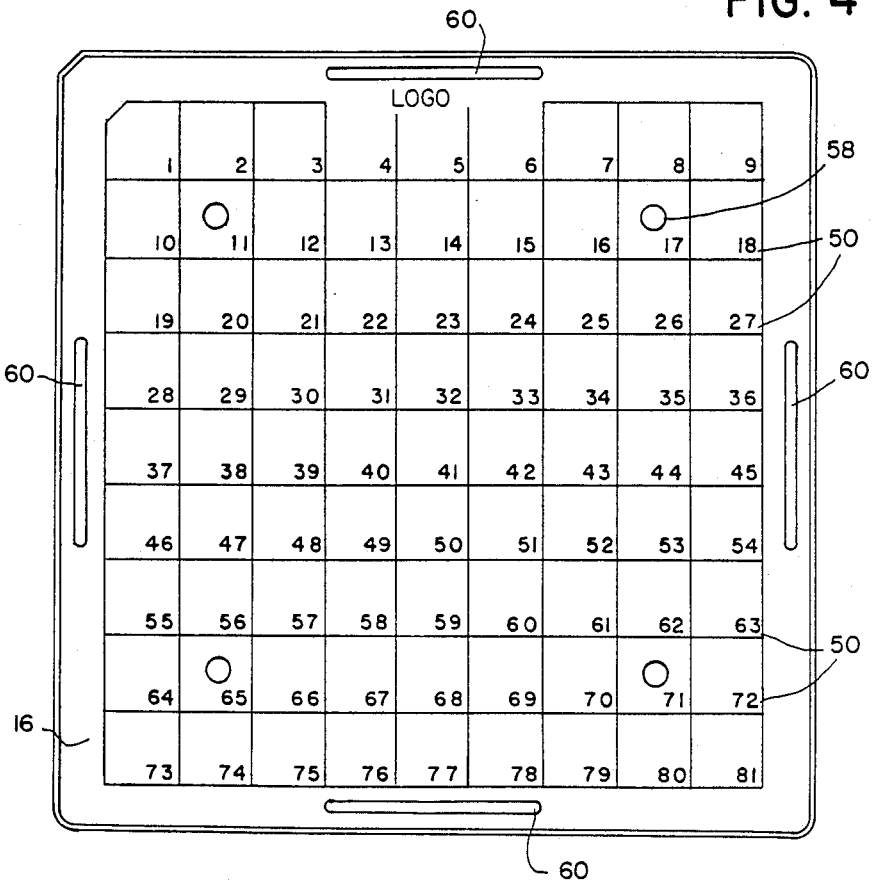
FIG. 4 is a top plan view of a modified form of a container made in accordance with the present invention.

Referring to FIG. 4, there is illustrated modified container 10 made in accordance with the present invention similar to that illustrated in FIG. 1. Like numerals referring to identical elements. As previously noted the present invention is particularly adapted for use as a cryogenic storage container. For the reasons previously discussed, it is important that identification and location of the vials within the containers be done as quickly and efficiently as possible. Applicants have unexpectedly found that in larger sizes as illustrated in FIG. 4 that in order to assure quick removal of the top cover from the base portion 14 after it has been removed from the cryogenic environment it is beneficial to provide narrow slot 60 on the top cover so as to minimize or prevent warping of the top cover. When the container is first removed from its cryogenic environment, i.e., temperatures below −70° Centigrade, the top cover has a tendency to warp and distort. Once the container warms up the warping or distortion subsides. However, precious time has passed in which to obtain the desired vial therein. Applicants have quite unexpectedly found that by the placement of the relatively narrow slots which extend through the cover approximately in the center of each side around the periphery thereof this minimizes or eliminates this initial distortion. Accordingly in order to assure quick and easy removal of the cover 14, slots 60 are each approximately 3.81 cm long and have a width of aobut 0.15 cm for a container having an overall size of about 13.3×13.3 cm. It is believed that the placement of the slots relieves stress experienced by the top cover when it is initally removed from the cryogenic environment. The particular size, shape and location may vary, however, these slots 60 are designed to relieve stress so as to prevent initial warping upon removal from a cold environment.

Various modifications to the present invention may be made without departing from the scope of the present invention. For example, various other indica may be used in place of the numerals for identifying the position of the openings 40. The retaining wall may be designed to be secured to the top cover and mate with the inside surface of the base portion. Additionally, the divider may be secured directly to the base portion. Further, as previously discussed. the particular number of openings or size of the container may be varied as desired.

What is claimed is:

1. A plastic container for holding an array of vials or other like articles comprising:

a base portion having a bottom wall, an upstanding peripheral wall extending from said bottom wall terminating at its upper end in a mating ridge portion;

a divider disposed within and secured to said base portion, said divider being spaced from said bottom wall of said base, said divider having a pluralityof openings each capable of receiving a vial or similar or other like articles, said divider having a retaining wall disposed around its periphery, said divider having on its upper surface indicia permanently affixed thereto and associated with each opening for identifying positions of each of said openings;

a top cover for placement on said base portion having a top wall, a peripheral outer wall extending downwardly from said top wall terminating at its lower end in a rim portion for mating with said ridge portion of said base portion and said outer retaining wall of said divider;

means for orienting said container so that said indicia on said divider is properly oriented for the user.

2. A plastic container according to claim 1 wherein said top cover is made of a material capable or receiving and maintaining a marking thereon from a writing instrument.

3. A plastic container according to claim 1 wherein said top cover and base portion have at least one opening therein for allowing flow of a medium therethrough.

4. A plastic container according to claim 1 further comprising means for allowing positioning of said top cover and base portion in only one way.

5. A plastic container according to claim 4 wherein said means for allowing positioning of said cover of said base portion in one way comprises said top portion and base portion being configured so as to mate with each other.

6. A plastic container according to claim 1 wherein said divider is a separate piece from said base portion and is secured to the base portion by projections which snap into position in said base portion.

7. A plastic container according to claim 1 wherein the top cover is provided with at least one slot along its periphery for minimizing warping of said top cover when it is first removed from a cryogenic environment.

8. A plastic container for holding an array of vials or the like articles comprising:

a base portion having a bottom wall, an upstanding peripheral wall extending from said bottom wall terminating at its upper end in a mating ridge portion;

a divider disposed within and secured to said base portion, said divider being spaced from said bottom wall between, said divider having a plurality of openings capable of receiving and mantaining position said plurality of vials, said divider having a retaining wall around the periphery thereof, said divider having on its upper surface indica permanently affixed thereto and associated with each opening for identification;

a top cover for placement on said bottom portion having a top wall, a peripheral outer wall extending downward from said top wall terminating at its lower end in a rim portion for mating with said ridge portion of said base portion and the outside surface of said retaining of said divider, the outer surface of said top wall of said top cover having a second indicia means corresponding to said first indicia identifying the respective positions of each of said openings in said divider;

means for orientating said container so that said indicia on said divider is properly orientated for the user.

9. A method for storing and retrieving a plurality of vials containing biological samples in a cold storage environment comprising providing a container having:

a base portion having a bottom wall and an upstanding peripheral outer wall extending outward from said bottom wall terminating in a ridge portion, an inner retaining wall disposed inward of said peripheral wall;

a divider disposed within and secured to said base portion having a plurality of openings therein each of said openings being sized so as to receive a single vial, said divider having a different indicia permanently affixed thereto and associated with each opening for identifying each of said openings, said divider having an outer retaining wall disposed axially inward of said ridged portion;

a top cover for mating with said base portion said top cover having a top wall, a downwardly extending peripheral wall which terminates in a rim portion for mating with said ridge portion of said base portion, the inside surface of said outer retaining wall of said divider;

means for orientating said container so that said indicia on said divider is properly vented for the user;

said method comprising the steps of:

placing said vial containing a biological sample in one of said openings in said shelf of said divider;

placing said container in storage;

removing said container for retrieval of one of said vials being stored therein;

orientating said container in response to said means for orientating said container, removing said top cover and retrieving said vial therefrom.

10. A method for storing and retrieving a plurality of vials containing biological samples in a cold storage environment comprising and providing a container having:

a base portion having a bottom wall, an upstanding peripheral wall extending from said bottom wall terminating at its upper end in a mating ridge portion;

a divider disposed within and secured to said base portion, said divider being spaced from said bottom wall between, said divider having a plurality of openings capable of receiving and mantaining position said plurality of vials, said divider having a retaining wall around the periphery thereof, said divider having on its upper surface indica permanently affixed thereto and associated with each opening for identification;

a top cover for placement on said bottom portion having a top wall, a peripheral outer wall extending downward from said top wall terminating at its lower end in a rim portion for mating with said ridge portion of said base portion and the outside surface of said retaining of said divider, the outer surface of said top wall of said top cover having a second indicia means corresponding to said first indicia identifying the respective positions of each of said openings in said divider;

means for orientating said container so that said indicia on said divider is properly orientated for the user;

said method comprising the steps of:

placing said vial containing a biological sample in one of said openings in said shelf of said divider;

placing said container in storage;

removing said container for retrieval of one of said vials being stored therein;

orientating said container in response to said means for orientating said container, removing said top cover and retrieving said vial therefrom.

* * * * *